US011135850B2

(12) United States Patent
Hiroi

(10) Patent No.: US 11,135,850 B2
(45) Date of Patent: Oct. 5, 2021

(54) HEAD CLEANING DEVICE, INKJET IMAGE FORMING APPARATUS, AND CLEANING METHOD

(71) Applicant: Konica Minolta Inc., Tokyo (JP)

(72) Inventor: Toshiaki Hiroi, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/681,649

(22) Filed: Nov. 12, 2019

(65) Prior Publication Data

US 2020/0156380 A1 May 21, 2020

(30) Foreign Application Priority Data

Nov. 19, 2018 (JP) ..... JP2018-216364

(51) Int. Cl.
*B41J 2/165* (2006.01)

(52) U.S. Cl.
CPC .... *B41J 2/16535* (2013.01); *B41J 2002/1655* (2013.01); *B41J 2002/16564* (2013.01); *B41J 2202/16* (2013.01); *B41J 2202/20* (2013.01)

(58) Field of Classification Search
CPC ..... B41J 2/16535; B41J 2/16585; B41J 2202/20; B41J 2002/1655; B41J 2202/16; B41J 2002/16564; B41J 2002/16573; B41J 2/16538; B41J 2/16541; B41J 2/16544; B41J 2/16547; B41J 2002/16558
See application file for complete search history.

(56) References Cited

FOREIGN PATENT DOCUMENTS

JP 2005-059437 A 3/2005
JP 2016-093944 A 5/2016

*Primary Examiner* — Kristal Feggins
(74) *Attorney, Agent, or Firm* — Squire Patton Boggs (US) LLP

(57) ABSTRACT

A head cleaning device includes: a cleaning member that comes into contact with a nozzle surface of an inkjet head from which ink is ejected, and performs a cleaning operation of cleaning the nozzle surface; and a hardware processor that controls the cleaning operation, wherein the hardware processor brings the nozzle surface of the inkjet head heated and the cleaning member into contact with each other, the hardware processor maintains the contact until a temperature of the nozzle surface that has decreased to a temperature below a threshold due to the cleaning member being brought into contact therewith reaches a temperature equal to or higher than the threshold, and the hardware processor controls the cleaning operation after the temperature of the nozzle surface has reached a temperature equal to or higher than the threshold.

14 Claims, 9 Drawing Sheets

FIG. 10

| AMBIENT TEMPERATURE [°C] | TEMPERATURE OF CONTACT SURFACE BETWEEN HEAD AND WIPING MEMBER ON CONTACT [°C] | COMPARATIVE EXAMPLE | EXAMPLE 1 |
|---|---|---|---|
| 30 | 70 | ○ | — |
| 20 | 60 | △ | ○ |
| 10 | 50 | × | ○ |

FIG. 11

| AMBIENT TEMPERATURE [°C] | WAITING TIME AFTER CONTACT [sec] | EXAMPLE 2 |
|---|---|---|
| 30 | 0 | — |
| 20 | 2 | ○ |
| 10 | 4 | ○ |

HEAD CLEANING DEVICE, INKJET IMAGE FORMING APPARATUS, AND CLEANING METHOD

The entire disclosure of Japanese patent Application No. 2018-216364, filed on Nov. 19, 2018, is incorporated herein by reference in its entirety.

BACKGROUND

Technological Field

The present invention relates to a head cleaning device, an inkjet image forming apparatus, and a cleaning method.

Description of the Related Art

In recent years, as apparatuses for recording high-definition images on various recording media such as paper and cloth, inkjet image forming apparatuses using a method of ejecting ink from nozzles of inkjet heads have been widely used. Inkjet image forming apparatuses provided include an inkjet image forming apparatus in which, for the purpose of removing ink and other foreign matter adhering to the nozzle surface of an inkjet head, a cleaning member (also referred to as a wiping member or a wipe material) such as a cloth or a blade is brought into contact (abutment) with the nozzle surface for cleaning (hereinafter referred to as head cleaning) (see JP 2016-93944 A and JP 2005-59437 A, for example).

When the inkjet image forming apparatus as described above uses ink that varies in viscosity by heating, each inkjet head is heated by a heater in the inkjet head to raise the temperature of the ink to adjust it to a viscosity suitable for ejection before ejecting the ink for image formation.

Here, FIG. 1 shows an example of the temperature transition of a nozzle surface when a cleaning member is brought into contact with the nozzle surface for cleaning in a conventional inkjet image forming apparatus. FIG. 1 is a plot in which the horizontal axis represents the passage of time (seconds) and the vertical axis represents actual measured values of the temperature (° C.) of an inkjet head surface (i.e. the nozzle surface). In the example shown in FIG. 1, the temperature of the inkjet head is raised to 80° C. by a heater of the inkjet image forming apparatus to adjust the viscosity of the ink to a suitable range before ink ejection (that is, printing on a recording medium).

Here, the temperature of the inkjet head surface (nozzle surface) held at about 80° C. decreases to about 60° C. when the cleaning member is brought into contact with the nozzle surface and the head cleaning is performed, as shown in FIG. 1. Then, the temperature of the nozzle surface returns to about 80° C. when the cleaning member is separated after the completion of the cleaning for about one second. When the temperature of the nozzle surface of the inkjet head decreases extremely during the head cleaning like this, the viscosity of ink adhering to the nozzle surface increases and can prevent the ink from being removed completely by the head cleaning using a cloth or a blade for wiping. If the ink adhering to the nozzle surface is not removed by the head cleaning, the ink and other foreign matter accumulate on the nozzle surface every time the ink is ejected, and nozzle ejection orifices are clogged by the ink and the foreign matter. This can cause ink ejection failure and consequently image quality degradation.

For the above problem, the technique described in JP 2016-93944 A proposes a method of cleaning after increasing the temperature of an inkjet head to a predetermined temperature or above before cleaning for cleaning ink that varies in viscosity depending on temperature. The technique described in JP 2005-59437 A proposes a method of detecting the temperature of an inkjet head and switching the speed of wiping operation according to the detected temperature for cleaning.

However, the technique described in JP 2016-93944 A has a problem that the amount of temperature decrease of a nozzle surface after a cleaning member is pressed against it varies, depending on the temperature of the cleaning member or the ambient temperature, preventing proper cleaning when the temperature of the cleaning member or the ambient temperature changes.

In the technique described in JP 2005-59437 A, when the temperature difference between a cleaning member and the inkjet head (usually, the cleaning member is lower in temperature) is large due to the temperature of the cleaning member and temperature distribution, the temperature of the nozzle surface of the inkjet head decreases greatly during wiping operation. Thus, the technique described in JP 2005-59437 A also has a problem that proper cleaning cannot be performed when the temperature of the cleaning member or the ambient temperature changes.

SUMMARY

An object of the present invention is to provide a head cleaning device, an inkjet image forming apparatus, and a cleaning method capable of maintaining cleaning performance even when the temperature of a cleaning member or the ambient temperature changes.

To achieve the abovementioned object, according to an aspect of the present invention, a head cleaning device reflecting one aspect of the present invention comprises: a cleaning member that comes into contact with a nozzle surface of an inkjet head from which ink is ejected, and performs a cleaning operation of cleaning the nozzle surface; and a hardware processor that controls the cleaning operation, wherein the hardware processor brings the nozzle surface of the inkjet head heated and the cleaning member into contact with each other, the hardware processor maintains the contact until a temperature of the nozzle surface that has decreased to a temperature below a threshold due to the cleaning member being brought into contact therewith reaches a temperature equal to or higher than the threshold, and the hardware processor controls the cleaning operation after the temperature of the nozzle surface has reached a temperature equal to or higher than the threshold.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 10 is a table showing the results of a first evaluation experiment; and FIG. 11 is a table showing the results of a second evaluation experiment.

DETAILED DESCRIPTION OF EMBODIMENTS

Hereinafter, one or more embodiments of the present invention will be described with reference to the drawings. However, the scope of the invention is not limited to the disclosed embodiments.

Figure 2:
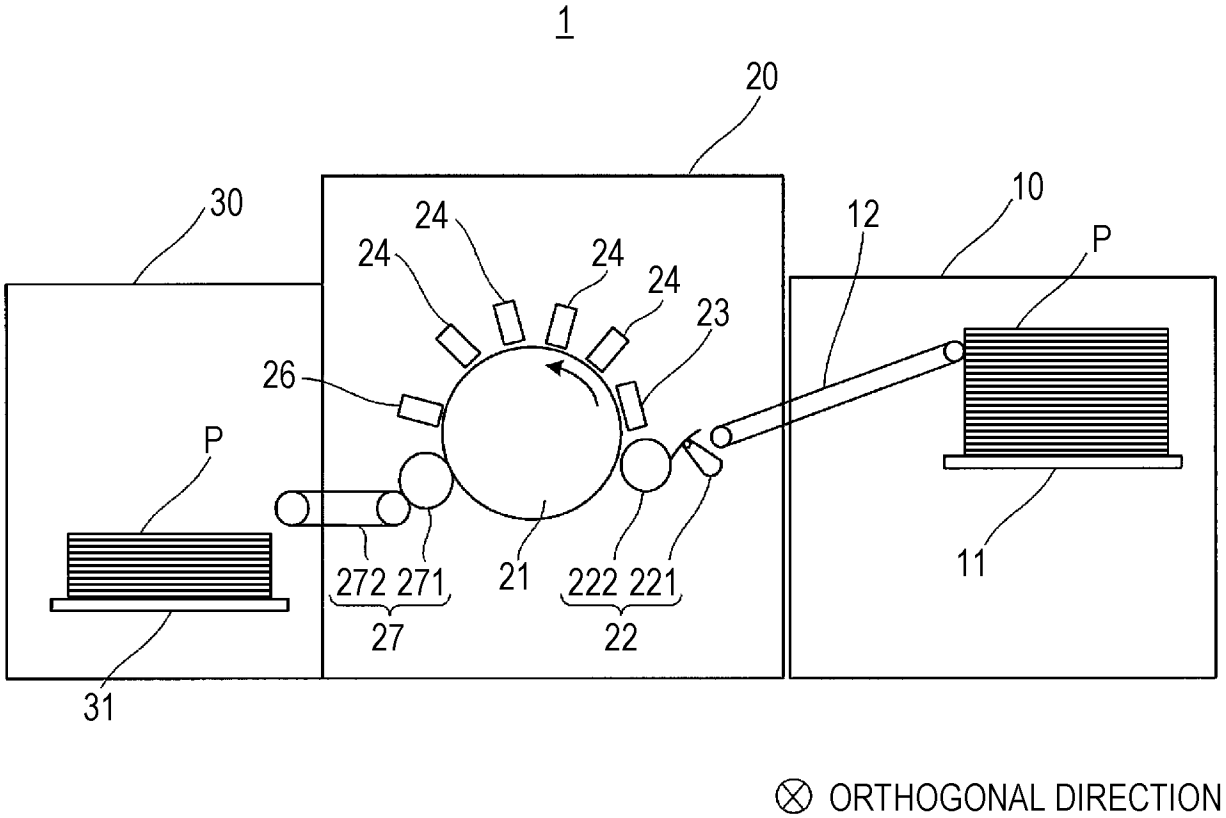
FIG. 2 is a schematic configuration diagram of an inkjet image forming apparatus in the present embodiment.

FIG. 2 is a schematic configuration diagram showing an example of an inkjet image forming apparatus 1 as the inkjet image forming apparatus according to the present invention.

Figure 3:
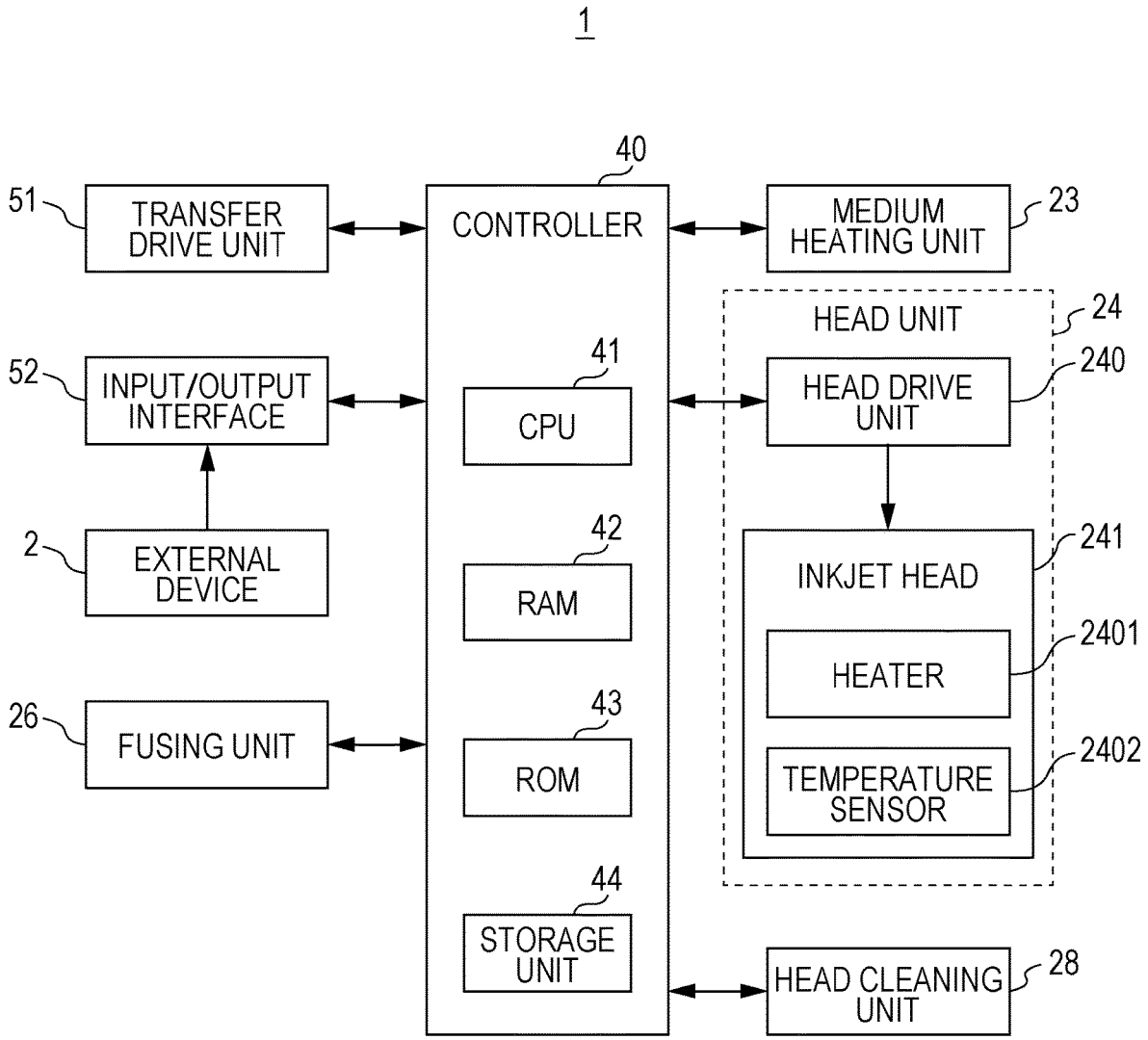
FIG. 3 is a block diagram illustrating the major functional configuration of the inkjet image forming apparatus in the present embodiment.

The inkjet image forming apparatus 1 includes a paper feed section 10, an image forming section 20, a paper output section 30, and a controller 40 (see FIG. 3). The inkjet image forming apparatus 1 transfers a recording medium P stored in the paper feed section 10 to the image forming section 20 under the control of the controller 40, forms an image on the recording medium P in the image forming section 20, and transfers (discharges) the recording medium P on which the image is formed to the paper output section 30. As the recording medium P, in addition to paper such as plain paper and coated paper, various media that allow ink landed on a surface to be fused into place, including cloth and sheet-shaped resin, can be used.

The paper feed section 10 includes a paper feed tray 11 in which the recording medium P is stored, and a medium feed unit 12 that transfers and feeds the recording medium P from the paper feed tray 11 to the image forming section 20.

The paper feed tray 11 is a plate-shaped member provided such that one or a plurality of recording media P can be placed thereon. The paper feed tray 11 is provided such that it moves up and down depending on the amount of the recording media P placed on the paper feed tray 11, and is held in a position in the up-and-down movement direction in which the uppermost recording medium P is transferred by the medium feed unit 12.

The medium feed unit 12 includes an annular belt supported by two rollers on the inside, and rotates the rollers with the recording medium P placed on the belt, thereby transferring the recording medium P from the paper feed tray 11 to the image forming section 20.

The image forming section 20 includes a transfer drum 21, a handover unit 22, a medium heating unit 23, head units 24, a fusing unit 26, a delivery unit 27, and a head cleaning unit 28 described later.

The transfer drum 21 rotates about a rotation axis extending in a direction perpendicular to the plane of FIG. 2 (hereinafter referred to as an "orthogonal direction") while holding the recording medium P on its outer peripheral curved surface in a cylindrical surface shape (transfer surface), thereby transferring the recording medium P in a transfer direction along the transfer surface (see an arrow in FIG. 2). The transfer drum 21 includes a claw and a suction unit (not shown) for holding the recording medium P on its transfer surface. The recording medium P is held by the claw at an edge thereof, and is drawn by the suction unit onto the transfer surface, thereby being held on the transfer surface. The transfer drum 21 has a transfer drum motor (not shown) for rotating the transfer drum 21, and rotates by an angle proportional to the rotation amount of the transfer drum motor. The transfer drum 21 and the transfer drum motor correspond to a "transferer" that transfers the recording medium P opposite the head units 24 (inkjet heads).

The handover unit 22 hands over the recording medium P transferred by the medium feed unit 12 of the paper feed section 10 to the transfer drum 21. The handover unit 22 is provided in a position between the medium feed unit 12 of the paper feed section 10 and the transfer drum 21, and holds and takes up one end of the recording medium P transferred from the medium feed unit 12 by a swing arm 221, and hands over it to the transfer drum 21 via a handover drum 222.

The medium heating unit 23 is provided between the disposed position of the handover drum 222 and the disposed position of the head units 24, and heats the transfer surface of the transfer drum 21 and the recording medium P such that the recording medium P transferred by the transfer drum 21 has a temperature within a predetermined range. The medium heating unit 23 includes, for example, an infrared heater, and supplies power to the infrared heater based on a control signal provided from the controller 40 (see FIG. 3), thereby heating the infrared heater.

The head units 24 eject ink to form (record) an image on the recording medium P from nozzle orifices provided in ink ejection surfaces facing the transfer surface of the transfer drum 21, at proper timings in accordance with the rotation of the transfer drum 21 on which the recording medium P is held. The head units 24 are disposed such that the ink ejection surfaces are separate from the transfer surface by a predetermined distance.

In the inkjet image forming apparatus 1 in the present embodiment, the four head units 24 corresponding to inks of four colors of yellow (Y), magenta (M), cyan (C), and black (K), individually, are aligned at predetermined intervals in the order of the colors of Y, M, C, and K from the upstream side in the transfer direction of the recording medium P.

Each head unit 24 includes an inkjet head 241 (see FIG. 3). The inkjet head 241 is provided with a plurality of recording elements each including a pressure chamber for storing ink, a piezoelectric element provided at a wall surface of the pressure chamber, and a nozzle. When a drive signal for deforming the piezoelectric element is input to the recording element, the pressure chamber is deformed by the deformation of the piezoelectric element, changing the pressure in the pressure chamber, so that the ink is ejected from the nozzle communicating with the pressure chamber.

The disposed range of the nozzles included in the inkjet head 241 in the orthogonal direction covers the width in the orthogonal direction of an area on which an image is recorded of the recording medium P transferred by the transfer drum 21. The head units 24 are used with their positions fixed with respect to the rotation axis of the transfer drum 21 during image formation. That is, the inkjet image forming apparatus 1 is a single-pass apparatus.

The head units 24 are provided individually movably along the orthogonal direction. Specifically, each head unit 24 is provided movably between the transfer drum 21 and the cleaning unit 28 provided along the orthogonal direction. Under the control of the controller 40, the head unit 24 moves to a position in which its lower surface faces the transfer drum 21 at the time of image formation and moves to a position in which its lower surface faces the cleaning unit 28 at the time of various kinds of maintenance.

The fusing unit 26 includes a light-emitting unit disposed across the width of the transfer drum 21 in the orthogonal direction. The fusing unit 26 irradiates the recording medium P placed on the transfer drum 21 with energy rays such as ultraviolet rays from the light-emitting unit, thereby applying predetermined energy to the ink ejected on the recording medium P and heating it to the temperature T2 [° C.] or above. This cures and fuses the ink into place.

The delivery unit 27 includes a belt loop 272 having an annular belt supported by two rollers on the inside, and a cylindrical handover drum 271 that hands over the recording medium P from the transfer drum 21 to the belt loop 272. The recording medium P handed over by the handover drum 271 from the transfer drum 21 onto the belt loop 272 is transferred by the belt loop 272 and delivered to the paper output section 30.

The paper output section 30 includes a plate-shaped paper output tray 31 on which the recording medium P delivered from the image forming section 20 by the delivery unit 27 is placed.

FIG. 3 is a block diagram showing the major functional configuration of the inkjet image forming apparatus 1. The inkjet image forming apparatus 1 includes the medium heating unit 23, an inkjet head drive unit ("head drive unit" in the figure) 240 and the inkjet head 241 of each head unit 24, the fusing unit 26, the head cleaning unit (hereinafter simply referred to as a cleaning unit) 28, the controller 40, a transfer drive unit 51, and an input/output interface 52.

The inkjet head drive unit 240 provides drive signals for deforming the piezoelectric elements in accordance with image data at proper timings to the recording elements of the inkjet head 241, based on the control of the controller 40, thereby causing amounts of ink corresponding to pixel values of the image data to be ejected from the nozzles of the inkjet lead 241. Actually, a plurality of inkjet heads 241 are aligned in each head unit 24. The number and alignment of inkjet heads 241 are the same as before, and thus detailed description thereof is omitted.

The controller 40 includes a central processing unit (CPU) 41, random-access memory (RAM) 42, read-only memory (ROM) 43, and a storage unit 44. In the present embodiment, the controller 40 controls head cleaning operation described later. The controller 40 also functions as a "determiner" of the present invention.

The CPU 41 reads various control programs and setting data stored in the ROM 43, stores them in the RAM 42, and executes the programs for various kinds of arithmetic processing. The CPU 41 centrally controls the entire operation of the inkjet image forming apparatus 1.

The RAM 42 provides a memory space for work to the CPU 41, and stores temporary data. The RAM 42 may include nonvolatile memory.

The ROM 43 stores various control programs executed by the CPU 41, setting data, etc. Instead of the ROM 43, a rewritable nonvolatile memory such as an electrically erasable programmable read-only memory (EEPROM) or a flash memory may be used.

The storage unit 44 stores a print job (image recording command) and image data related to the print job input from an external device 2 via the input/output interface 52. As the storage unit 44, for example, a hard disk drive (HDD) is used, and dynamic random access memory (DRAM) or the like may be used in combination.

The transfer drive unit 51 provides a drive signal to the transfer drum motor of the transfer drum 21 based on a control signal provided from the controller 40, to rotate the transfer drum 21 at a predetermined speed and timing. The transfer drive unit 51 also provides a drive signal to a motor for driving the medium feed unit 12, the handover unit 22, and the delivery unit 27 based on a control signal provided from the controller 40, to cause them to feed the recording medium P to the transfer drum 21 and discharge the recording medium P from the transfer drum 21.

The input/output interface 52 mediates data transmission and reception between the external device 2 and the controller 40. The input/output interface 52 is formed, for example, by one of various serial interfaces and various parallel interfaces, or a combination thereof.

The external device 2 is, for example, a personal computer, and provides an image recording command (print job), image data, etc. to the controller 40 via the input/output interface 52.

Here, the ink used in the inkjet image forming apparatus 1 of the present embodiment will be described. The ink used for image formation in the inkjet image forming apparatus 1 has the property of undergoing a phase change (phase transition) depending on the temperature of the ink. Specifically, the ink changes in phase between a gel or a solid and a liquid depending on temperature. An example of the composition of this ink is a composition mainly of a polymerizable compound and a photopolymerization initiator with some percent of a gelling agent added thereto.

Figure 4:
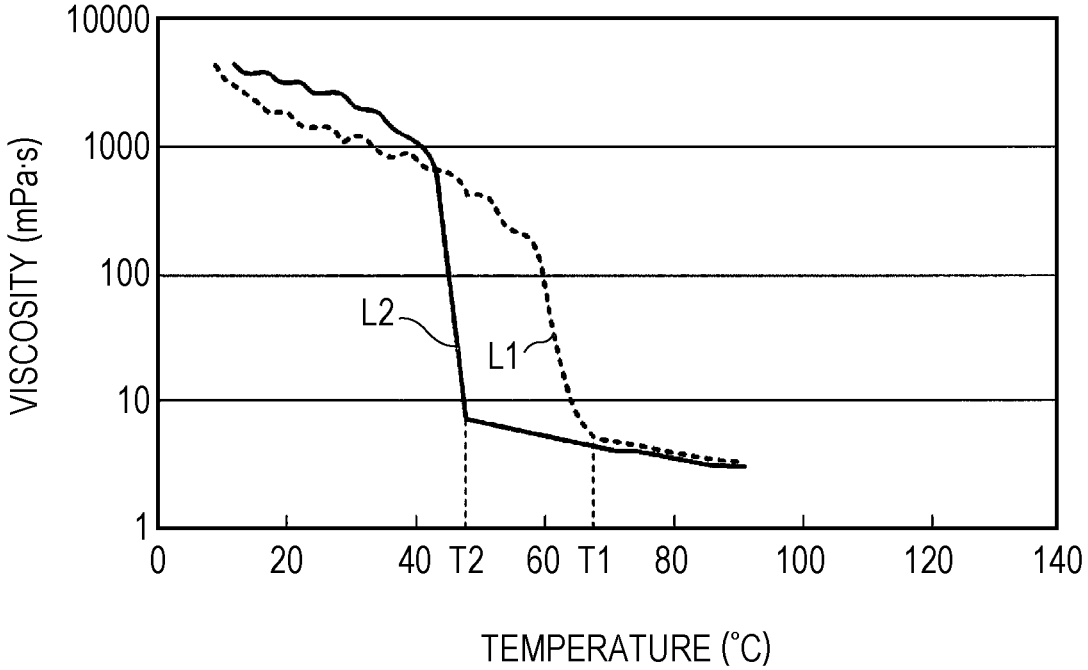
FIG. 4 is a graph showing an example of changes in viscosity of ink with increases and decreases in temperature of the ink.

FIG. 4 shows an example of changes in the viscosity of the ink used in the inkjet image forming apparatus 1 of the present embodiment with increases and decreases in the temperature of the ink. In FIG. 4, a characteristic line L1 indicated by a dotted line represents an example of changes in the viscosity of the ink when the temperature increases, and a characteristic line L2 indicated by a solid line represents an example of changes in the viscosity of the ink when the temperature decreases.

As shown by the characteristic line L1 in FIG. 4, when the temperature increases, at around 60° C. the ink undergoes a phase change (phase transition) in which the viscosity changes significantly. Specifically, the ink in a gel state or a solid state at a temperature below 60° C. significantly decreases in viscosity when it exceeds around 60° C. due to the temperature increase, and changes into a liquid state at the temperature T1 [° C.] (about 70° C. in this example). In the example shown in FIG. 4, the temperature T1 (about 70° C.) is a first phase transition temperature (liquefaction temperature).

On the other land, as indicated by the characteristic line L2 in FIG. 4, when the temperature decreases, at around 50° C., the ink undergoes a phase change in which the viscosity changes more significantly than in the phase change when the temperature increases. Specifically, the ink held in a liquid state to a temperature just above 50° C. very significantly increases in viscosity from when it falls below 50° C. due to the temperature decrease, and changes into a gel state or a solid state. In the example shown in FIG. 4, the temperature T2 [° C.] of about 50° C. is a second phase transition temperature (gelation temperature).

The ink is stored in an ink tank (not shown) in the head unit 24, and is supplied from the ink tank to the inkjet head 241 through an ink tube.

Next, with reference to FIG. 5, the schematic configuration of the cleaning unit 28 will be described. The cleaning unit 28 is provided adjacent to the transfer drum 21 in the orthogonal direction, and comes into contact with a nozzle surface 241*a* of the inkjet head 241 after printing or after maintenance and wipes the nozzle surface 241*a*, removing the ink and other foreign matter adhering to the nozzle surface 241*a*.

The cleaning unit 28 includes a wiping cloth 281 that wipes the nozzle surface 241*a*, an elastic member 282 that comes into contact with or separates from the nozzle surface 241*a* via the wiping cloth 281, an unwinding roller 283 that feeds the wiping cloth 281 to the nozzle surface 241*a*, a winding roller 284 that winds up the wiping cloth 281, and a drive source such as a motor for driving the rollers 283 and 284 and the elastic member 282. The drive source operates based on the control (a drive signal) of the controller 40.

Of the above, the wiping cloth 281 corresponds to a "cleaning member" of the present invention. The cleaning unit 28 includes a waste ink unit (not shown) that receives and stores the ink ejected from the nozzle (nozzle surface 241*a*) during maintenance. By providing the waste ink unit, the interior of the image forming section 20 is prevented from being soiled by the ink ejected from the head unit 24 during maintenance.

The wiping cloth 281 is a sheet member in an elongated shape, and has a length in the width direction formed to a size that can cover the entire lower surface of the head unit 24 (i.e. the nozzle surfaces 241*a*). The wiping cloth 281 may be any that can remove the ink and other foreign matter adhering to the nozzle surfaces 241*a* of the inkjet heads 241 constituting the head unit 24. For example, a nonwoven fabric or the like is used.

In the present embodiment, the wiping cloth 281 is unwound from the unwinding roller 283, based on a drive signal of the controller 40, wipes the nozzle surface 241*a*, and then is wound up by the winding roller 284. Thus, the wiping cloth 281 is replaceable. When the elastic member 282 comes into contact with or separates from the nozzle surface 241*a* of the inkjet head 241, the wiping cloth 281 moves together with the elastic member 282, based on a drive signal of the controller 40 (see a double-headed arrow in FIG. 5).

The elastic member 282 faces the lower surface of the head unit 24 via the wiping cloth 281, and its opposed surface is formed to a size that can cover the entire lower surface of the head unit 24 (i.e. the nozzle surfaces 241*a* of the inkjet heads 241). The elastic member 282 is movable in a substantially vertical direction relative to the lower surface of the head unit 24, that is, the nozzle surface 241*a*. The material of the elastic member 282 may be any such as sponge or rubber as long as it does not damage the nozzles etc. even when pressed against the nozzle surface 241*a* of the inkjet head 241.

By the elastic member 282 like this moving in the substantially vertical direction relative to the nozzle surface 241*a*, the wiping cloth 281 is pressed against the nozzle surface 241*a* with a uniform force in a surface direction, and the wiping cloth 281 can be brought into close contact with the nozzle surface 241*a*.

Figure 5:
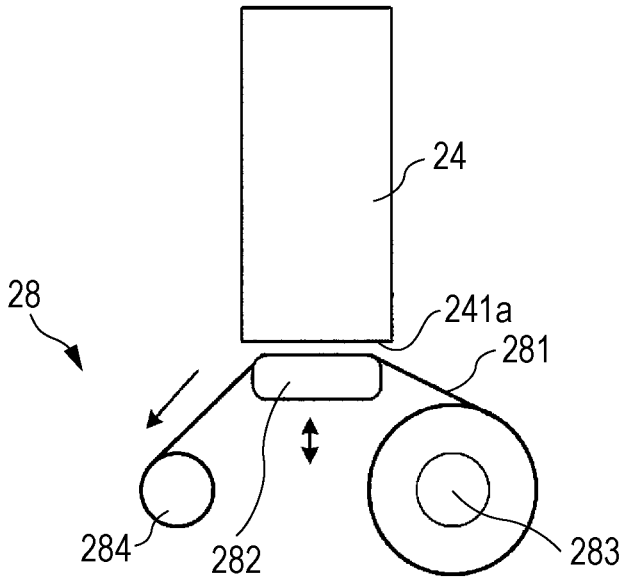
FIG. 5 is a schematic view showing a head unit in which an inkjet head is housed and a head cleaning unit.

As a specific example of the head cleaning operation after the elastic member 282 moves upward from the state shown in FIG. 5 and presses the wiping cloth 281 against the nozzle surface 24*a*, the head unit 24 is caused to reciprocate in horizontal directions (for example, in lateral directions in FIG. 5). Alternatively, as another specific example of the head cleaning operation after the wiping cloth 281 is pressed against the nozzle surface 241*a* as described above, the unwinding roller 283 and the winding roller 284 may be rotated without moving the head unit 24 to cause the wiping cloth 281 to move in a left direction in FIG. 5. By the head cleaning operation as described above, the ink and other foreign matter adhering to the nozzle surface 241*a* can be wiped and removed with the wiping cloth 281.

As shown in FIG. 3, the inkjet head 241 includes a heater 2401 as a heating unit. The heater 2401 includes, for example, a heating wire, and generates heat in response to energization. In one specific example, the heater 2401 is provided in the above-described pressure chamber (also referred to as a common ink chamber) in the inkjet head 241. In the present embodiment, the heater 2401 generates heat, thereby heating the ink in the inkjet head 241 and also heating the nozzle surface 241*a* of the inkjet head 241.

The pressure chamber of the inkjet head 241 is provided with a temperature sensor 2402 (see FIG. 3) for measuring the temperature of the ink. Based on the detection result of the temperature sensor 2402, the controller 40 controls power supplied to the heater 2401 so that the temperature of the ink during ink ejection of the inkjet head 241 (during normal printing) reaches a proper temperature.

By the way, in the conventional inkjet image forming apparatus provided with the cleaning unit 28 as described above, when the wiping cloth 281 (cleaning member) is pressed against the nozzle surface 241*a*, the amount of temperature decrease of the nozzle surface 241*a* varies, depending on the temperature of the wiping cloth 281 or the elastic member 282 or the ambient temperature, and can prevent proper head cleaning.

Figure 6:
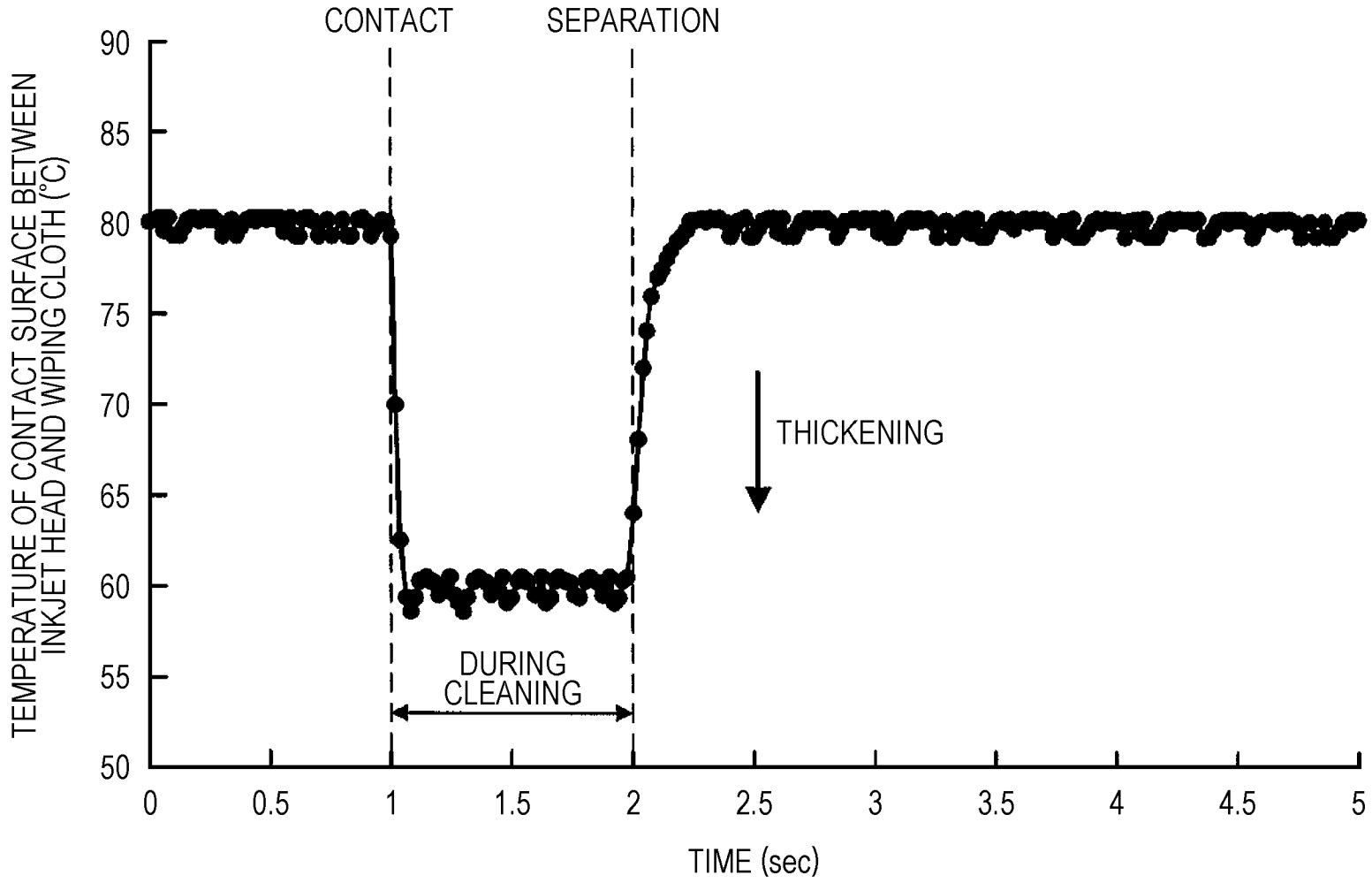
FIG. 6 is a plot of actually measured temperature changes during cleaning operation in a conventional configuration.

Hereinafter, this problem will be described in more detail with reference to FIGS. 4 and 6 described above. FIG. 6 is a chart of actually measured temperature changes during the head cleaning operation in the conventional inkjet image forming apparatus.

In general, the viscosity of ink used in an inkjet image forming apparatus varies depending on temperature. As an example, for ink that undergoes a phase transition at an ink temperature of 50 to 70° C., changing in viscosity as described in FIG. 4, the ink undergoes a phase transition by being heated to 50 to 70° C. by a heater or the like, and varies in viscosity depending on temperature even if the temperature is outside the phase transition range (below 50° C. or 71° C. or above in this example).

As described above, the ink illustrated in FIG. 4 has phase transition points of the temperature T1 (about 70° C.) and the temperature T2 (about 50° C.) at the time of temperature rise (the characteristic line L1) and at the time of temperature drop (the characteristic line L2), respectively. In this case, the controller 40 needs to perform control (temperature management) so that the inkjet head 241 has at least the phase transition temperature T1 (about 70° C.) or above during ink ejection (during printing) and during head cleaning. In one specific example, from the viewpoint of ejection stability during printing and head maintenance during head cleaning, the controller 40 performs temperature control to keep the temperature of the inkjet head 241 at, for example, 75 to 80° C. to stabilize the viscosity of the ink in the head unit 24.

On the other hand, the temperature of the wiping cloth 281 and the elastic member 282 (hereinafter referred to as the "wiping cloth etc.") varies, depending on the atmospheric environment in which the inkjet image forming apparatus 1 is placed. For example, in an environment where the ambient temperature is 10° C., the temperature of the wiping cloth etc. is also about 10° C., and in an environment where the ambient temperature is 30° C., the temperature of the wiping cloth etc. is also about 30° C.

When the head cleaning operation described above is performed under conditions as described above, the temperature of a contact surface between the surface of the inkjet head 241 (the nozzle surface 241*a*) and the wiping cloth 281 during cleaning rapidly decreases, depending on the temperature of the wiping cloth etc. Here, FIG. 6 shows the results of actual measurement of the temperature of the nozzle surface 241*a* with which the wiping cloth 281 was brought into contact (hereinafter simply referred to as the "contact surface") when the above-described head cleaning operation (wiping operation of the wiping cloth 281) was performed in an environment where the ambient temperature, that is, the temperature of the wiping cloth etc. was 23° C.

In the example shown in FIG. 6, the contact surface is maintained at about 80° C. before the start of the wiping operation (0 to 1 (sec) in FIG. 6). In contrast, by the wiping cloth 281 coming into contact with the nozzle surface 241*a* immediately before the start of the wiping operation (see "contact" in FIG. 6), the temperature of the contact surface rapidly decreases to about 60° C. Then, the temperature of the contact surface remains at about 60° C. during the wiping operation (see "during cleaning" in FIG. 6). By the wiping cloth 281 that has completed the wiping operation separating from the nozzle surface 241*a* (see "separation" in FIG. 6), the temperature of the contact surface quickly returns to about 80° C.

Thus, in the conventional head cleaning operation the temperature of the contact surface deviates from a proper temperature range (75 to 80° C. in this example) from the start to the end of the wiping operation, and the ink viscosity increases (see "thickening" in FIG. 6). When the wiping operation is performed with the ink having a higher viscosity, the thickening ink adheres to the nozzle surface 241*a* of the inkjet head 241 or adheres to the wiping cloth 281 and then adheres to the nozzle surface 241*a*. This tends to cause image defects at the time of later printing. In addition, when the ambient temperature is lower, there may be a case where the temperature of the contact surface decreases to the temperature T2 (a gelation temperature of about 50° C.) described above with reference to FIG. 4 during the wiping operation. In this case, an additional problem may occur, such as occurrence of ink clogging in the nozzles of the inkjet head 241.

As a result of conducting the above-described actual measurement and various experiments, the present inventors have come to obtain findings that the temperature management of the contact surface is important for proper head cleaning.

Figure 7:
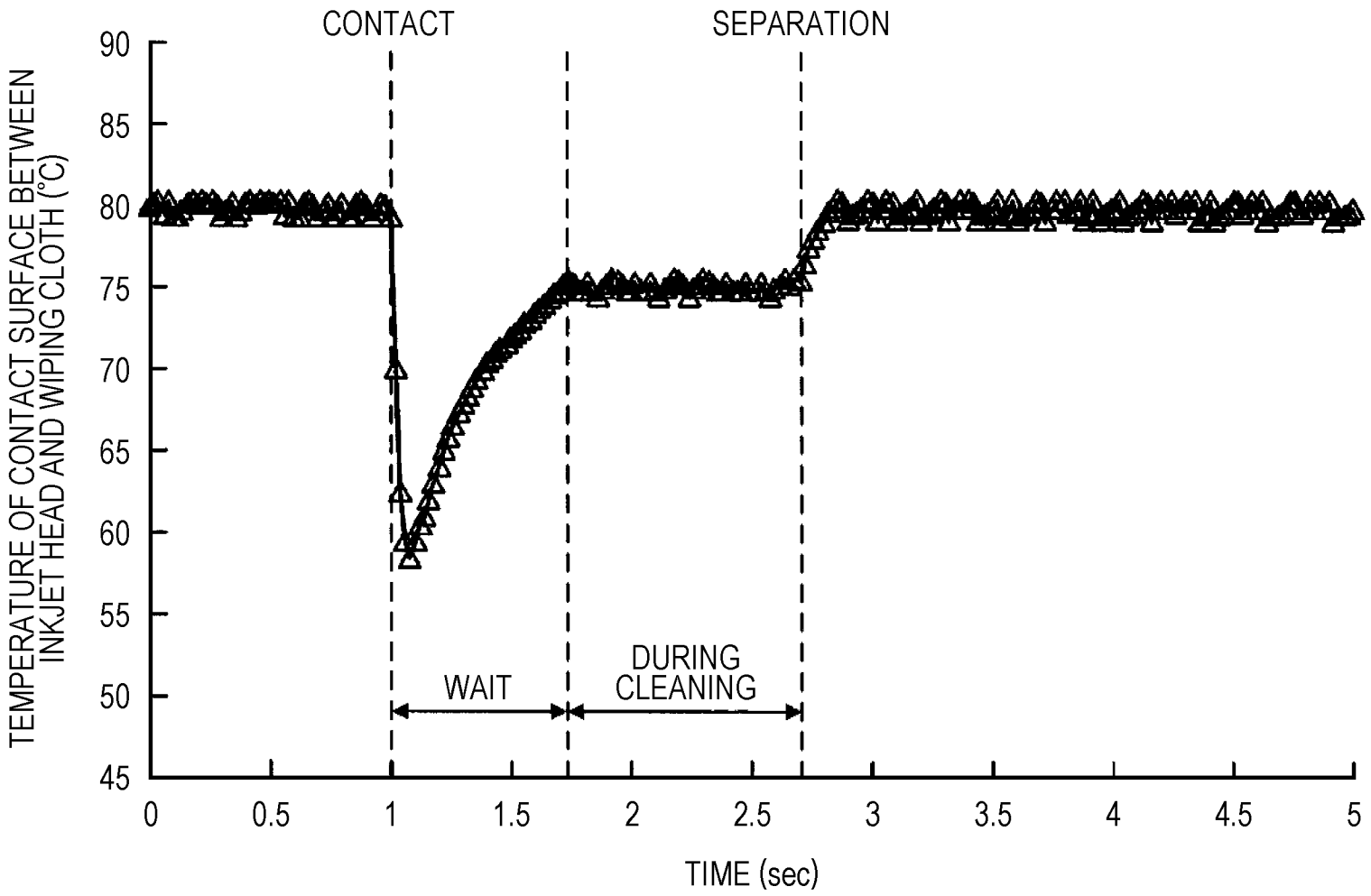
FIG. 7 is a plot of actually measured temperature changes of a contact surface between the inkjet lead and a cleaning member during head cleaning in the present embodiment.

Based on the findings, in the inkjet image forming apparatus 1 of the present embodiment, the nozzle surface 241*a* of the inkjet head 241 heated and the wiping cloth 281 (cleaning member) are brought into contact with each other at the time of head cleaning, and the contact is maintained until the temperature of the nozzle surface 241*a* (contact surface) that has decreased to a temperature below a threshold due to the wiping cloth 281 being brought into contact therewith reaches a temperature equal to or higher than the threshold, and after the temperature of the contact surface has reached the temperature equal to or higher than the threshold, the operation of wiping the nozzle surface 241*a* with the wiping cloth 281 is performed. FIG. 7 is a plot of actually measured temperature changes of the contact surface during the head cleaning in the present embodiment.

Figure 1:
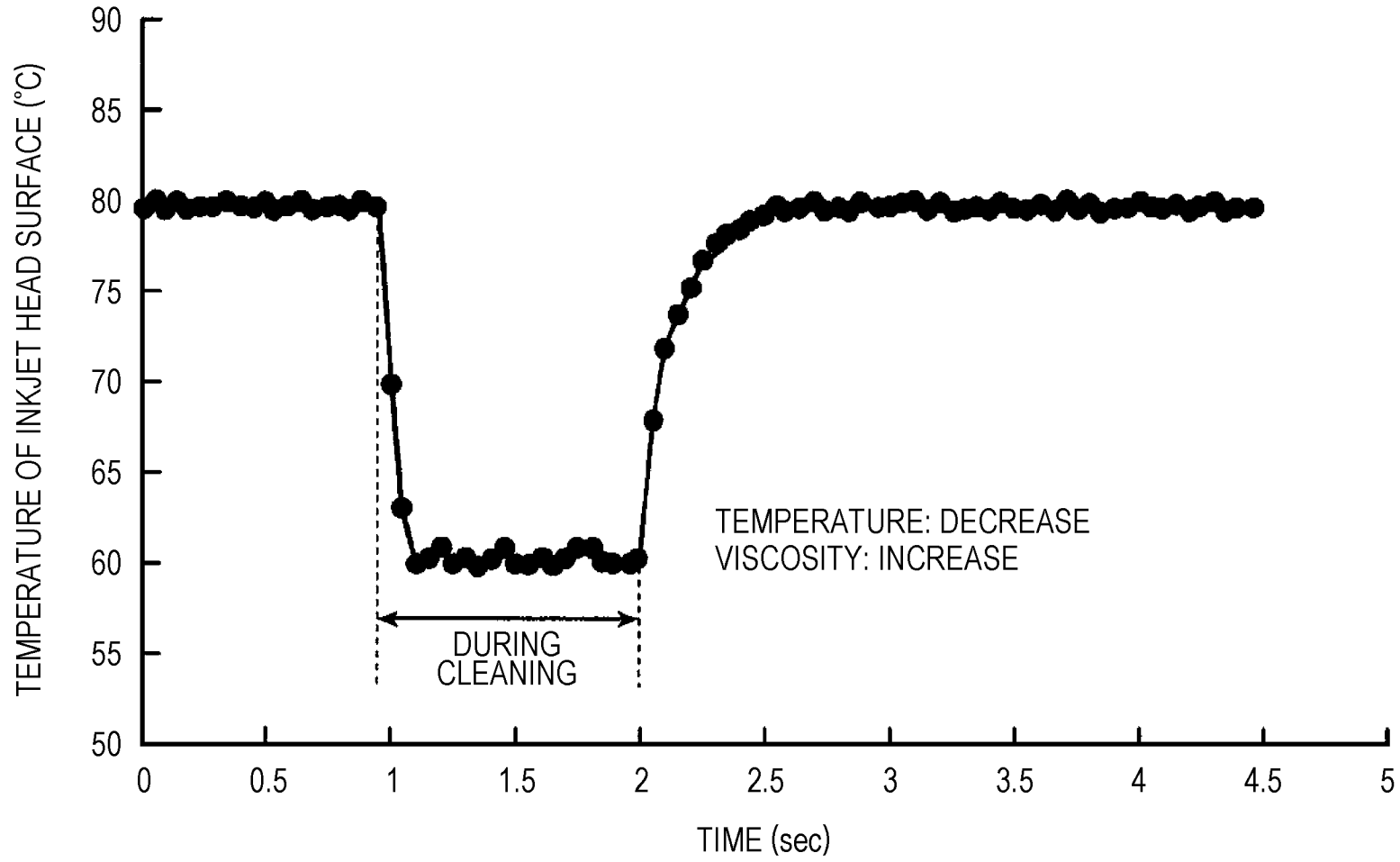
FIG. 1 is a graph showing an example of temperature transition of an inkjet head surface during cleaning in a conventional technique.

Specifically, in the conventional technique, after the wiping cloth 281 is brought into contact with the nozzle surface 241*a* of the inkjet head 241, the wiping operation on the nozzle surface 241*a* (that is, the relative movement of the wiping cloth 281 and the nozzle surface 241*a*) is immediately started as shown in FIGS. 1 and 6. By contrast, in the present embodiment, after the operation of bringing the wiping cloth 281 into contact with the nozzle surface 241*a* of the inkjet head 241 (this operation causes the temperature of the contact surface to rapidly decrease), as shown in FIG. 7, the wiping operation is not performed and in wait until the temperature of the contact surface rises to the threshold (a predetermined temperature) (see the period of "wait" in FIG. 7). At a point in time when the temperature of the contact surface reaches the threshold (75° C. in the example of FIG. 7), the above-described wiping operation is started. The operation like this can prevent degradation in cleaning performance even when the temperature of the wiping cloth etc. or the ambient temperature changes.

Figure 8:
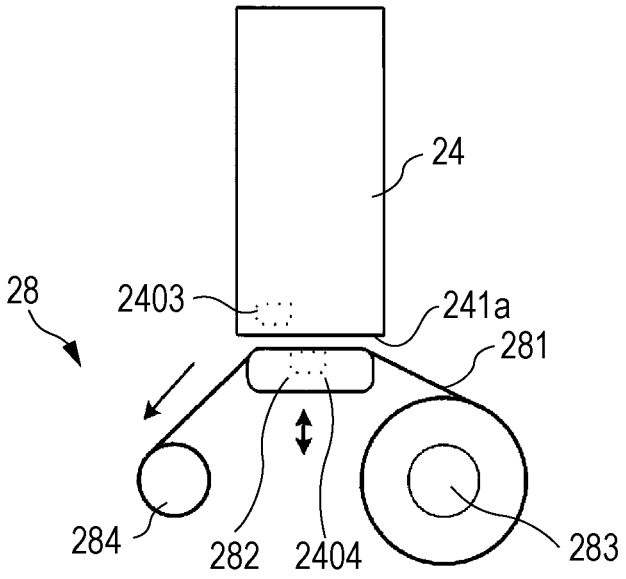
FIG. 8 is a diagram illustrating the head unit and the head cleaning unit in the present embodiment.

In the present embodiment, as shown in FIG. 8, a temperature sensor 2403 is additionally provided in the vicinity of the nozzle surface 241*a* of the inkjet head 241 for measuring the temperature of the contact surface. The temperature sensor 2403 is different from the temperature sensor 2402 in the pressure chamber described above with reference to FIG. 3, and corresponds to a "first temperature detector" of the present invention. Based on the detection result of the temperature sensor 2403, the controller 40 determines whether the contact surface has reached a temperature equal to or higher than the threshold. When it determines that the temperature has reached a temperature equal to or higher than the threshold, it controls the cleaning unit 28 (the winding roller 284 etc. described above) to perform the wiping operation.

As another configuration example, as shown in FIG. 8, a temperature sensor 2404 may be provided in an upper portion of the elastic member 282. The temperature sensor 2404 corresponds to a "second temperature detector" installed in a position opposite the nozzle surface 241*a* of the inkjet head 241 with the wiping cloth 281 (cleaning member) therebetween. Based on the detection result of the temperature sensor 2404, the controller 40 determines whether the contact surface has reached a temperature equal to or higher than the threshold. When it determines that the contact surface has reached a temperature equal to or higher than the threshold, it controls the cleaning unit 28 to perform the wiping operation.

Alternatively, both the temperature sensor 2403 (first temperature detector) and the temperature sensor 2404 (second temperature detector) described above may be provided. In this case, based on the detection results of the temperature sensors 2403 and 2404 (for example, based on the mean value of detected temperatures of the two sensors 2403 and 2404), the controller 40 determines whether the contact surface has reached a temperature equal to or higher than the threshold. When it determines that the contact surface has reached a temperature equal to or higher than the threshold, it controls the cleaning unit 28 to perform the wiping operation.

Further, a method for determining whether the contact surface has reached a temperature equal to or higher than the threshold may be as follows. Specifically, based on the temperature of the wiping cloth 281 before the nozzle surface 241*a* and the wiping cloth 281 come into contact with each other, the controller 40 estimates the time from when the nozzle surface 241*a* and the wiping cloth 281 come into contact with each other to when the temperature of the nozzle surface 241*a* reaches the threshold, and determines whether the contact surface has reached a temperature equal to or higher than the threshold based on whether the estimated time has elapsed. Here, the temperature of the wiping cloth 281 before the nozzle surface 241*a* and the wiping cloth 281 come into contact with each other can be estimated from the ambient temperature detected by an existing temperature sensor provided in the inkjet image forming apparatus 1 (i.e. a temperature around the cleaning unit 28). Alternatively, when the temperature sensor 2404 (second temperature detector) is provided, the temperature of the wiping cloth 281 before the nozzle surface 241*a* and the wiping cloth 281 come into contact with each other can be estimated from the detection result of the temperature sensor 2404.

If the temperature decrease of the contact surface on contact between the nozzle surface 241*a* and the wiping cloth 281 is small (for example, if the ambient temperature or the temperature of the wiping cloth 281 is high), there may be a case where it is not necessary to maintain the contact between the nozzle surface 241*a* and the wiping cloth 281 (see "wait" in FIG. 7).

Therefore, in one specific example, based on temperatures detected by the temperature sensor 2403 (first temperature detector) or 2404 (second temperature detector) before and after contact between the nozzle surface 241*a* and the wiping cloth 281 when the head cleaning is performed, the controller 40 determines whether the temperature decrease of the nozzle surface 241*a* is below a preset value (predetermined value). When the controller 40 determines that the temperature decrease is below the predetermined value, it controls the cleaning unit 28 to immediately perform the operation of wiping the nozzle surface 241*a* with the wiping cloth 281. This control enables an improvement in productivity while performing proper head cleaning.

The "predetermined value" is not limited to a particular value. However, the results of the experiments conducted by the present inventors show that when the temperature decrease of the contact surface was below 10° C., even the conventional head cleaning operation, in which the holding of contact between the nozzle surface 241*a* and the wiping cloth 281 ("wait" in FIG. 7) was not performed, did not cause problems such as image defects at the time of later printing. On the other hand, as a result of performing the conventional head cleaning operation when the temperature decrease of the contact surface was 10° C. or higher, although at an acceptable level, minor image noise due to ejection deflection occurred at the time of later printing. Further, as a result of performing the conventional head cleaning operation when the temperature decrease of the contact surface was 30° C. or higher, unacceptably severe image noise due to ejection deflection occurred at the time of later printing. In view of these results, the "predetermined value" is preferably set to a value smaller than at least 30° C. and tore preferably, set to 10° C. Details of experimental conditions etc. in the above experiments will be described later.

Figure 9:
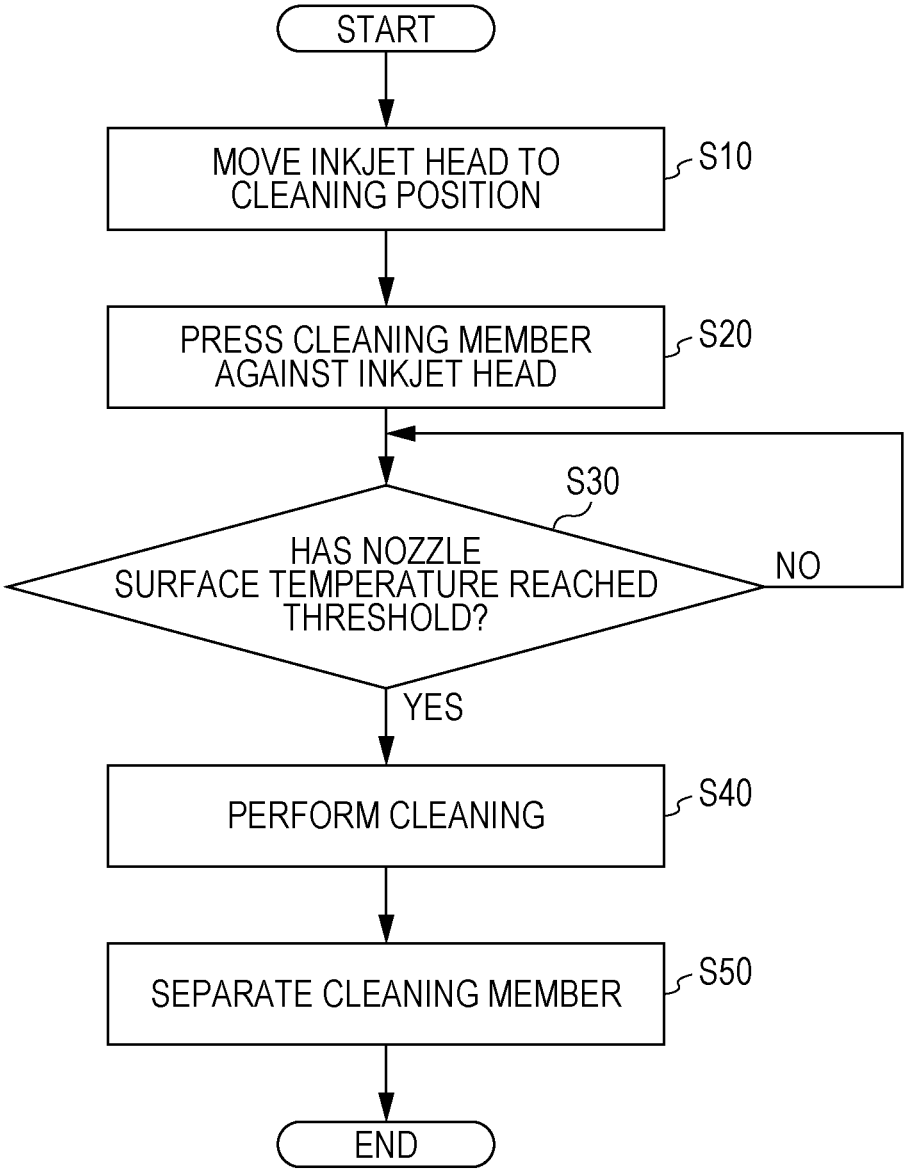
FIG. 9 is a flowchart showing an example of a nozzle surface cleaning process in the present embodiment.

An example of a head cleaning process of the nozzle surface 241*a* performed by the controller 40 in the inkjet image forming apparatus 1 configured as described above will be described with reference to FIG. 9. FIG. 9 is a flowchart showing an example of the cleaning process of the nozzle surface 241*a*. The process in steps S10 to S50 shown in FIG. 9 is performed after ink ejection for image formation, maintenance, or the like.

Prior to the process in step S10, the controller 40 supplies power to the heater 2401, heating the inkjet head 241 so that the temperature of the nozzle surface 241*a* reaches a temperature higher than a set temperature at the time of ink ejection, and a temperature lower than an ink polymerization temperature (e.g., 80° C.). The control to this temperature brings a state suitable for cleaning the nozzle surface 241*a*. As a specific example for this temperature control, the controller 40 supplies power to the heater 2401 while monitoring detected temperatures of the temperature sensor 2402 in the pressure chamber (see FIG. 3) and the temperature sensor 2403 in the vicinity of the nozzle surface 241*a* (see FIG. 8).

Then, in step S10, the controller 40 moves the inkjet head 241 (in this example, the head unit 24 in which the plurality of inkjet heads 241 are housed) to a cleaning position where the cleaning unit 28 is disposed.

Subsequently, the controller 40 outputs a drive signal to the cleaning unit 28 to press the elastic member 282 against the nozzle surface 241*a* of the inkjet head 241 with the wiping cloth 281 interposed therebetween (step S20). This operation brings the wiping cloth 281 (cleaning member) into contact with the nozzle surface 241*a*, so that the wiping cloth 281 and the nozzle surface 241*a* come into close contact with each other. In many cases, this operation significantly reduces the temperature of the contact surface between the nozzle surface 241*a* of the inkjet head 241 and the wiping cloth 281 (see "contact" in FIG. 7).

Next, the controller 40 determines whether the temperature of the nozzle surface 241*a* has reached a threshold (e.g., 75° C.) set according to the type of ink used (step S30). At this time, if the controller 40 determines that the temperature of the nozzle surface 241*a* has not reached the threshold (step S30. NO), the controller 40 continues the process of supplying power to the heater 2401, and repeatedly performs the determination in step S30 (see the period of "wait" in FIG. 7). If the controller 40 determines that the temperature of the nozzle surface 241*a* has reached the threshold (step S30, YES), the controller 40 proceeds to step S40.

In step S40, the controller 40 performs the above-described head cleaning operation, that is, the operation of wiping the nozzle surface 241*a* with the wiping cloth 281 for a predetermined time (e.g., one second) (see the period of "during cleaning" in FIG. 7).

In step S50 after the completion of the head cleaning operation, the controller 40 outputs a drive signal to the cleaning unit 28 to separate the elastic member 282 together with the wiping cloth 281 from the nozzle surface 241*a* (see "separation" in FIG. 7).

According to the present embodiment in which this process is performed, even if the temperature of the wiping cloth 281 (cleaning member) or the ambient temperature changes, degradation of lead cleaning performance can be prevented.

In the above-described embodiment, the case where the cleaning member is the wiping cloth 281 has been described. On the other hand, the cleaning member is not limited to this, and may alternatively be a blade that cones into contact with the nozzle surface 241*a* of the inkjet head 241, for example. In this case, the blade is made of an elastic material such as urethane rubber, and the head unit 24 and the blade in contact with the nozzle surface 241*a* move relative to each other in the longitudinal direction of the inkjet head 241, to remove ink mist and other foreign matter adhering to the nozzle surface 241*a*.

Although the above-described embodiment uses gel ink that undergoes a phase transition due to a viscosity change, ink that does not undergo a phase change depending on temperature (e.g., water-soluble ink) may be used.

Experimental Example

Finally, evaluation experiments 1 and 2 for confirming the effects in the configuration of the above embodiment will be described.

(Experimental Method Etc.)

First, matters common to the experiments will be described. In each experiment, the wiping cloth 281 in the form of cloth knitted with fibers made of nylon and polyester of a thickness of 0.5 m was used as the cleaning member. Ink used was ink having the characteristics described above with reference to FIG. 4 (i.e. the two phase transition temperatures T1 and T2). The heating temperature of the inkjet head 241 was set and controlled such that the nozzle surface 241*a* was heated to 80° C. by the temperature sensor 2403 installed at the nozzle surface 241*a* (see FIG. 8) and the heater 2401 that heats the inkjet head 241 (see FIG. 3), from the viewpoint of ejection stability.

Comparative Example

Prior to the evaluation experiments, a comparative experiment was conducted for confirming the problem of the conventional technique. Specifically, using an inkjet image forming apparatus of the conventional configuration, cleaning of the inkjet head 241 was performed with the ambient temperature in which the inkjet image forming apparatus was placed set to various temperatures of 10° C. to 30° C. or more, and after the cleaning, a test image was printed on a recording medium P to check whether an image defect or the like occurred.

In the comparative experiment, when the ambient temperature was set to 30° C. the temperature of the contact surface decreased to about 70° C. on contact between the inkjet head 241 and the wiping cloth 281, and the temperature decrease (temperature difference) from the above control temperature (80° C.) was limited to below 10° C. In this case, image noise (ejection deflection) did not occur at the time of later printing. In addition, when the same experiment was conducted with the ambient temperature set to various temperatures of 30° C. and higher, no image noise (ejection deflection) occurred at the time of later printing likewise. As a result, it has been confirmed that when the temperature of the contact surface on contact between the inkjet head 241 and the wiping cloth 281 decreases within a range of below 10° C. relative to the control temperature, head cleaning is performed normally by the conventional head cleaning method.

When the ambient temperature was set to 20° C., the temperature of the contact surface on contact between the inkjet head 241 and the wiping cloth 281 decreased to about 60° C., and the temperature decrease from the control temperature (80° C.) was 20° C. In this case, acceptable minor image noise due to ejection deflection occurred at the time of later printing. In addition, the same experiment was conducted with the ambient temperature set to various temperatures of around 20° C. It has been found that when the temperature of the contact surface on contact between the inkjet head 241 and the wiping cloth 281 decreases within the range of 10° or above to below 30° C. relative to the control temperature, image noise (ejection deflection) within an allowable range occurs at the time of later printing. The image noise (ejection deflection) is considered to have occurred because the viscosity of the ink adhering to the nozzle surface 241*a* increased due to the temperature decrease of the contact surface, degrading the cleaning performance by the wiping operation of the wiping cloth 281.

When the ambient temperature was set to 10° C., the temperature of the contact surface on contact between the inkjet head 241 and the wiping cloth 281 decreased to about 50° C. and the temperature decrease from the control temperature (80° C.) reached 30° C. In this case, unacceptable severe image noise due to ejection deflection occurred at the time of later printing. In addition, the same experiment was conducted with the ambient temperature set to various temperatures below 10° C. It has been confirmed that when the temperature of the contact surface on contact between the inkjet head 241 and the wiping cloth 281 decreases by 30° C. or above relative to the control temperature, image noise (ejection deflection) outside the allowable range occurs at the time of later printing. The image noise (ejection deflection) is considered to have occurred because the temperature of the contact surface between the inkjet head 241 and the wiping cloth 281 fell below the phase transition point (the temperature T2 shown in FIG. 4), and the viscosity of the ink rapidly increased, thus degrading the cleaning performance or causing the ink to adhere again from the wiping cloth 281.

The results of the above comparative experiment are shown in the "comparative example" column in the table of FIG. 10. In the table of FIG. 10, "○" indicates a case where no image noise (ejection deflection) occurred and a high-quality image was obtained, "Δ" a case where image noise (ejection deflection) within the allowable range (up to a specification upper limit) occurred, and "x" a case where image noise (ejection deflection) outside the allowable range (out of specification) occurred. The evaluations of "○", "Δ", and "x" are the same in examples described later and the table of FIG. 11.

(Evaluation Experiment 1)

In evaluation experiment 1 for confirming the effects of the above-described embodiment, until the temperature of the contact surface between the inkjet head 241 and the wiping cloth 281 reached a predetermined temperature as a threshold (75° C. in this example) after the contact of the wiping cloth 281, the above-described wiping operation was not performed and in wait. At a point in time when the temperature of the contact surface reached 75° C., the wiping operation was performed. The temperature of the contact surface between the inkjet head 241 and the wiping cloth 281 was measured by the temperature sensor 2403 installed at the nozzle surface 241*a* of the inkjet head 241 (see FIG. 8). FIG. 7 described above shows an example of the measurement results.

In evaluation experiment 1, the wait and the wiping operation at a point in time when the temperature of the contact surface reached 75° C. were performed under ambient temperature conditions (below 30° C. to 10° C. or lower) that resulted in "Δ" or "x" in the comparative experiment described above. In evaluation experiment 1, since the wiping operation was started after the temperature of the contact surface between the inkjet head 241 and the wiping cloth 281 reached 75° C. which was a temperature at which the ink viscosity was kept properly, the ink on the nozzle surface 241*a* of the inkjet head 241 did not thicken, allowing proper cleaning with the wiping cloth 281. Further, according to evaluation experiment 1, no image noise (ejection deflection) occurred at the time of printing after the head cleaning, and a high-quality image was obtained. The above results are shown in the "Example 1" column of the table in FIG. 10.

(Evaluation Experiment 2)

In evaluation experiment 2, for the temperature of the contact surface between the inkjet head 241 and the wiping cloth 281, the time from when the wiping cloth 281 came into contact with the inkjet head 241 was measured, and based on whether a predetermined time associated with an ambient temperature under which the inkjet image forming apparatus 1 was placed had elapsed, it was determined (estimated) whether the temperature of the contact surface had reached a predetermined temperature (75° C.). In evaluation experiment 2, in consideration of errors etc., the wiping operation was not performed until an estimated timing when the temperature of the contact surface between the inkjet head 241 and the wiping cloth 281 exceeded the predetermined temperature (75° C.) after the contact of the wiping cloth 281. Evaluation experiment 2 was performed under the same ambient temperature conditions as those of evaluation experiment 1 except for the above.

First, before evaluation experiment 2, the actual time from when the wiping cloth 281 came into contact with the inkjet head 241 to when the temperature of the contact surface reached the predetermined temperature (75° C.) was measured. As a result, when the ambient temperature was 20° C., the contact surface reached the predetermined temperature (75° C.) when about one second had elapsed since the wiping cloth 281 came into contact with the inkjet head 241. When the ambient temperature was 10° C., the contact surface reached the predetermined temperature (75° C.) when about three seconds had elapsed since the wiping cloth 281 came into contact with the inkjet head 241.

Based on the results, in evaluation experiment 2, when the wiping operation was started after waiting two seconds at an ambient temperature of 20° C., and waiting four seconds at an ambient temperature of 10° C. a high-quality image was obtained without occurrence of image noise (ejection deflection) at the time of later printing. The above results are summarized in the table of FIG. 11 (see the "Example 2" column).

Thus, according to the head cleaning method of the present embodiment, it has been confirmed that the head cleaning performance can be maintained even when the temperature of the wiping cloth 281 (cleaning member) or the ambient temperature changes.

Suitable values for the above-mentioned numerical values such as the waiting time vary, depending also on the type of the wiping cloth 281 (cleaning member), the type of ink, or the configuration of the cleaning unit 28, and are not limited to the values in the above examples.

Although embodiments of the present invention have been described and illustrated in detail, the disclosed embodiments are made for purposes of illustration and example only and not limitation. That is, the present invention can be implemented in various forms without departing from its scope or its major features. The scope of the present invention should be interpreted by terms of the appended claims.

What is claimed is:

1. A head cleaning device comprising:

a cleaning member that comes into contact with a nozzle surface of an inkjet head from which ink is ejected, and performs a cleaning operation of cleaning the nozzle surface; and a hardware processor that controls the cleaning operation, wherein the hardware processor controls a drive source for the drive source to bring the nozzle surface of the inkjet head heated and the cleaning member into contact with each other, the hardware processor controls the drive source for the drive source to maintain the contact until a temperature of the nozzle surface that has decreased to a temperature below a threshold due to the cleaning member being brought into contact therewith reaches a temperature equal to or higher than the threshold, and the hardware processor controls the cleaning operation after the temperature of the nozzle surface has reached a temperature equal to or higher than the threshold.

2. The head cleaning device according to claim 1, wherein the hardware processor determines whether the temperature of the nozzle surface has reached a temperature equal to or higher than the threshold, and the hardware processor controls the cleaning operation when it is determined that the temperature of the nozzle surface has reached a temperature equal to or higher than the threshold.

3. The head cleaning device according to claim 2, wherein the hardware processor determines whether the temperature of the nozzle surface has reached a temperature equal to or higher than the threshold, based on a result of detection by a first temperature detector provided in the vicinity of the nozzle surface.

4. The head cleaning device according to claim 2, wherein the hardware processor determines whether the temperature of the nozzle surface has reached a temperature equal to or higher than the threshold, based on a result of detection by a second temperature detector provided in a position opposite the nozzle surface of the inkjet head with the cleaning member therebetween.

5. The head cleaning device according to claim 2, wherein the hardware processor determines whether the temperature of the nozzle surface has reached a temperature equal to or higher than the threshold, based on a result of detection by a first temperature detector provided in the vicinity of the nozzle surface, and a result of detection by a second temperature detector provided in a position opposite the nozzle surface of the inkjet lead with the cleaning member therebetween.

6. The head cleaning device according to claim 2, wherein the hardware processor estimates a time from when the nozzle surface and the cleaning member are brought into contact with each other to when the temperature of the nozzle surface reaches a temperature equal to or higher than the threshold, based on a temperature of the cleaning member before the nozzle surface and the cleaning member are brought into contact with each other, and determines whether the temperature of the nozzle surface has reached a temperature equal to or higher than the threshold based on whether the estimated time has elapsed.

7. The head cleaning device according to claim 6, wherein the hardware processor estimates the temperature of the cleaning member before the nozzle surface and the cleaning member are brought into contact with each other from a temperature around the head cleaning device.

8. The head cleaning device according to claim 1, wherein the inkjet head is heated to a temperature higher than a set temperature at a time of ink ejection and lower than a polymerization temperature of the ink when the nozzle surface and the cleaning member are brought into contact with each other.

9. The head cleaning device according to claim 1, wherein the hardware processor performs control to immediately execute an operation of cleaning the nozzle surface of the inkjet head with the cleaning member if a temperature decrease of the nozzle surface when the cleaning member is brought into contact with the nozzle surface is below a predetermined value.

10. The head cleaning device according to claim 1, wherein the ink varies in viscosity depending on temperature.

11. The head cleaning device according to claim 10, wherein the ink undergoes a phase transition due to a change in the viscosity, and has a phase transition temperature T1 [° C.] at a time of temperature rise and a phase transition temperature T2 [° C.] (T1>T2) at a time of temperature drop.

12. The head cleaning device according to claim 11, wherein the hardware processor performs control such that the nozzle surface of the inkjet head reaches the phase transition temperature T1 [° C.] or above when the nozzle surface and the cleaning member are brought into contact with each other.

13. An inkjet image forming apparatus comprising:

the head cleaning device according to claim 1; and a transferer that transfers a recording medium opposite the inkjet head.

14. A cleaning method of bringing a cleaning member into contact with a nozzle surface of an inkjet head for performing an operation of cleaning the nozzle surface, the method comprising:

bringing the nozzle surface of the inkjet head heated and the cleaning member into contact with each other;

maintaining the contact until a temperature of the nozzle surface that has decreased to a temperature below a threshold due to the cleaning member being brought into contact therewith reaches a temperature equal to or higher than the threshold; and performing the operation of cleaning the nozzle surface with the cleaning member after the temperature of the nozzle surface has reached a temperature equal to or higher than the threshold.

* * * * *